US006845927B1

(12) United States Patent
Masson

(10) Patent No.: US 6,845,927 B1
(45) Date of Patent: Jan. 25, 2005

(54) COMPRESSED AIR PISTOL WITH BLOWOUT NOZZLE

(76) Inventor: Lucien Masson, Hubrainweg 20a, CH-8124 Maur (CH)

( * ) Notice: Subject to any disclaimer, the term of this patent is extended or adjusted under 35 U.S.C. 154(b) by 0 days.

(21) Appl. No.: 10/019,339

(22) PCT Filed: May 23, 2000

(86) PCT No.: PCT/EP00/04691

§ 371 (c)(1),
(2), (4) Date: Apr. 22, 2002

(87) PCT Pub. No.: WO01/00328

PCT Pub. Date: Jan. 4, 2001

(51) Int. Cl.[7] ..... B05B 1/30

(52) U.S. Cl. ..... 239/569; 251/339; 128/66; 137/320

(58) Field of Search ..... 239/569, 576, 239/577; 251/339, 346, 350, 354; 128/66; 137/320, 322

(56) References Cited

U.S. PATENT DOCUMENTS

| | | | | |
|---|---|---|---|---|
| 703,103 A | * | 6/1902 | Borsum et al. | 604/246 |
| 3,117,726 A | | 1/1964 | Schöberg | |
| 3,570,525 A | * | 3/1971 | Borsum et al. | 137/320 |
| 4,063,708 A | | 12/1977 | Smith | |
| 5,988,593 A | * | 11/1999 | Rice | 251/354 |

FOREIGN PATENT DOCUMENTS

| | | |
|---|---|---|
| DE | 76 19 463 | 11/1976 |
| DE | 77 33 595 | 4/1979 |
| DE | 80 34 525.1 | 5/1981 |
| DE | 86 29 691.4 | 2/1987 |
| DE | 91 11 322.9 | 3/1992 |
| DE | 297 08 014 | 8/1997 |
| DE | 298 01 178 | 9/1998 |
| EP | 670 253 | 9/1995 |
| WO | WO 83/01748 | 5/1983 |

* cited by examiner

*Primary Examiner*—Michael Mar
*Assistant Examiner*—Thach H. Bui
(74) *Attorney, Agent, or Firm*—The Maxham Firm

(57) ABSTRACT

A pressurized fluid nozzle having a system carrier with a hose connection for supplying a pressurized medium and an outlet valve having at least one outlet nozzle. The system carrier is designed to accommodate an integrated, adjustable pressure-reducing valve. Furthermore, the system carrier has a system sleeve and a hose socket, which is connected to it, whereby a compressed air shield and/or a connection for a pressure gauge and/or a protection against accidental contact is/are integrated into the hose socket. In a preferred embodiment, components of the blow-out gun also serve at the same time to connect and support the hose and/or the finger guard and/or the extension tube for supplying the pressurized medium, and these components together with the hose can be removed from the system carrier.

21 Claims, 6 Drawing Sheets

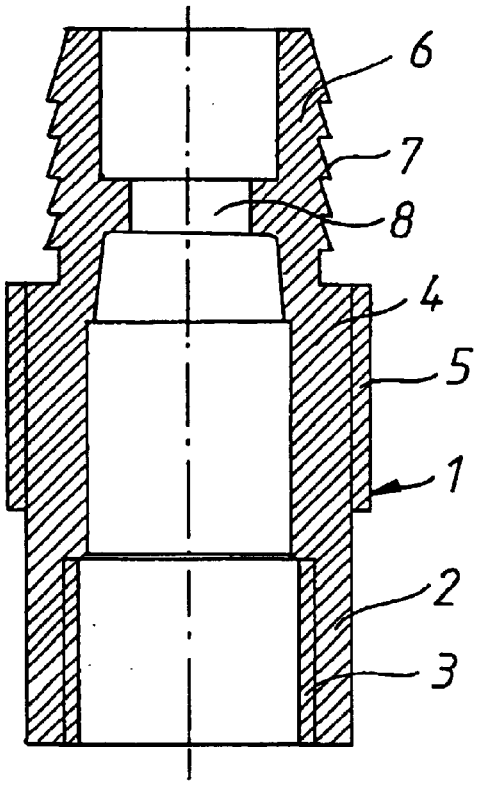
FIG. 2
FIG. 3
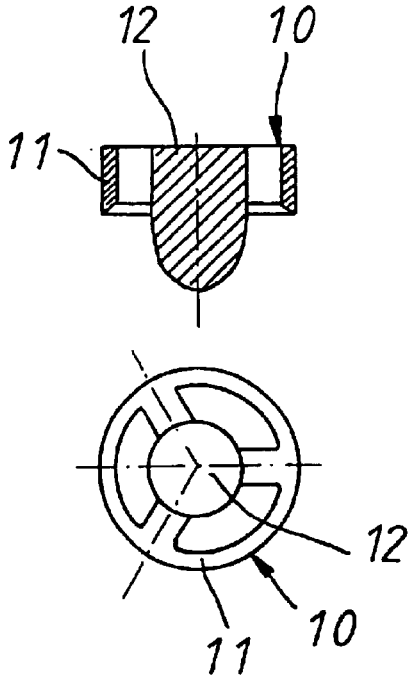
FIG. 4

COMPRESSED AIR PISTOL WITH BLOWOUT NOZZLE

BACKGROUND OF THE INVENTION

1. Field of the Invention

This invention relates to pressurized fluid nozzle, and more particularly to a nozzle assembly having an adjustable pressure reducing valve and operator safety features.

2. Discussion of Related Art

Compressed air nozzles are well known from the related art, in particular for their use as blow-out guns. The blow-out guns used up to now have consisted of a system carrier, for example, which may be connected to a high pressure hose by means of a hose connection for supplying a pressurized medium. Furthermore, a manually or automatically operated outlet valve is also provided, whereby when this valve is operated, the pressurized medium flows out through an outlet nozzle or into a working machine to be activated to work. However, the systems available so far on the market, especially the blow-out guns, entail safety risks when used improperly. When blowing out a workpiece without using safety goggles, eye injuries may occur due to blowback of chips and particles of dirt. Furthermore, it occurs every so often that such blowout guns are used against people either as a joke or to clean their work clothes, which thus results in painful wounds on the skin or intestinal rupture to the abdomen. To minimize such known accident risks, there are known air reducing valves which reduce the normal operating pressure of the compressed air supply from 6 to 10 bar down to approximately 0.5 to 1 bar especially for hazardous areas of use, in particular for cleaning and blow-out jobs. This pressure level is usually sufficient for blowing out workpieces and is also stipulated by law in several countries. Such pressure reducing valves are connected between the blow-out gun and the high-pressure hose so that the entire device becomes rather heavy and difficult to handle. It has generally been complicated and expensive to perform the pressure measurement at the point of use and therefore it is rarely done.

SUMMARY OF THE INVENTION

A primary purpose of this invention is to improve upon a compressed air nozzle of the type defined above so that it meets the required or recommended safety standards and occupational safety regulations and guarantees easier handling at a much lower production cost. The invention also enables making appropriate pressure measurements. A preferred use of the compressed air nozzle of the invention is for it to be designed as a blow-out and cleaning nozzle (gun).

This invention is based essentially on the fact that the system carrier is designed to accommodate an integrated adjustable air-reducing valve. The integrated adjustable air-reducing valve permits flexible use of the compressed air nozzle and avoids risks in compressed air systems with a high operating pressure.

In a preferred embodiment, an insert with a sealing element which, together with a regulator piece which is displaceable relative to the sealing element and a regulating sleeve of the air reducing valve, is inserted into the system sleeve beneath the tilt valve. The throughput of the air-reducing valve is preferably adjustable by turning or shifting the regulating sleeve within the system sleeve. A lock nut is preferably provided for locking the regulating sleeve in the set position to lock an airflow level once it has been set. A hose socket is preferably arranged in the upper area of the system sleeve in such a way that it cannot be released. It is preferably made of a stable and durable elastomer.

In a preferred embodiment, the system sleeve is surrounded by an outer sleeve, whereby the lower section of the hose socket is accommodated between the system sleeve and the outer sleeve. The hose socket and the outer sleeve thus form an elastic material protection so that damage to sensitive workpiece surfaces is prevented. The hose socket preferably has a lower section for attaching to the system sleeve and a middle section with a finger rest and a finger guard for operation of the tilt valve, and an upper section with a tip which has a central outlet nozzle for the compressed medium.

In another alternative embodiment, a concentric nozzle is arranged around the central outlet nozzle, serving to produce an air shield. This air shield forms a so-called eye-protecting screen and reduces the risk of injury to the operating person due to chips and particles of dirt blown back. The molded finger rest permits convenient metering control of the outlet valve and prevents the finger from slipping off when the operator's hands are oily or greasy. An additional flip guard is provided by the integrally molded ring flange.

In yet another embodiment, a ring projection is provided between the central outlet nozzle and the ring nozzle, projecting beyond the tip of the hose socket and serving as protection against accidental contact. This prevents a high-pressure buildup when the tip comes in direct contact with the skin or other sensitive surfaces. The compressed air can escape at the side unhindered.

In still another embodiment, the ring projection and ring nozzle are designed to receive the connection of a conventional automotive tire air pressure gauge. This reduces to a few seconds the time required on the part of an operating safety person to check the pressure, making it a no-charge activity.

In an alternative refinement of this invention, the regulating piece and the regulating sleeve are designed for connection and for supporting the hose for the supply of the compressed medium to thereby gain some important advantages with regard to weight, cost and especially ease of handling. The compressed air hose is inserted between the regulating piece and the regulating sleeve, and the resulting hose connection can be screwed into the system sleeve conveniently and in a space-saving and self-sealing manner.

In another alternative embodiment, an air-reducing valve may be omitted. A connection sleeve is inserted into the system sleeve and together with a clamping piece it serves to connect and support a compressed air hose for supplying the compressed medium. Here again, the compressed air hose is inserted between the connection sleeve and the clamping piece, thus maintaining the advantages of low weight, low cost manufacture, low space requirement, self-sealing effect and thus also improved handling. The outlet valve is preferably designed as a tilt valve, with the hose socket enclosing the tilt valve.

The term "compressed air" is used throughout this document but it is to be understood that the nozzle assembly of this invention can be employed with pressurized fluid other than air.

BRIEF DESCRIPTION OF THE DRAWING

The objects, features and advantages of the invention will be more clearly perceived from the following detailed description, when read in conjunction with the accompanying drawing, in which:

FIG. 2 is a longitudinal section through the system sleeve of FIG. 1;

FIG. 3 is a longitudinal section through the insert with the sealing element of FIG. 1;

FIG. 4 is a top view of the insert of FIG. 3 with the sealing element;

DETAILED DESCRIPTION OF THE PREFERRED EMBODIMENTS

Figure 1:
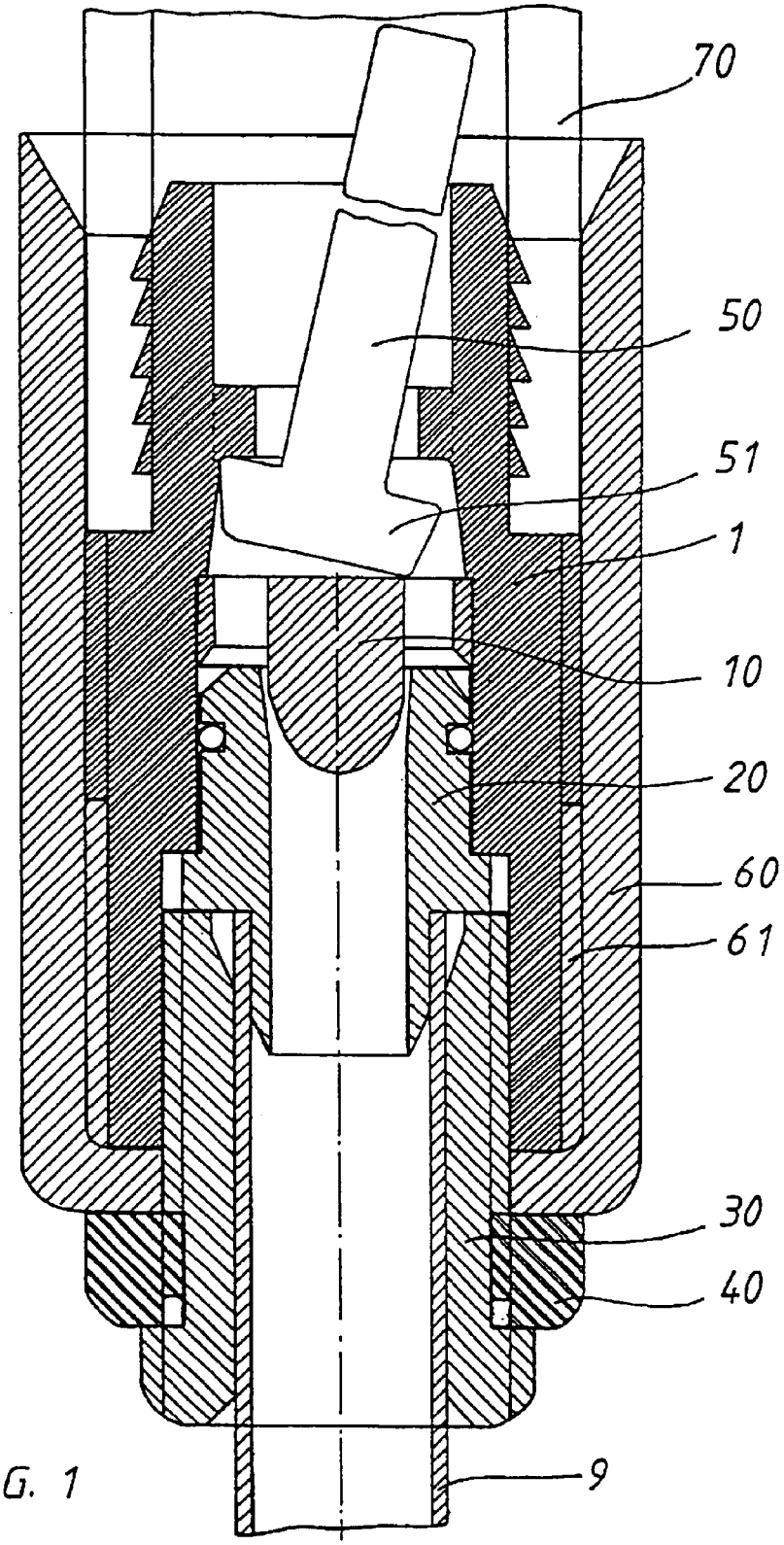
FIG. 1 is a longitudinal section through the compressed air nozzle in a preferred embodiment of the invention which includes an integrated air-reducing valve.
Figure 5:
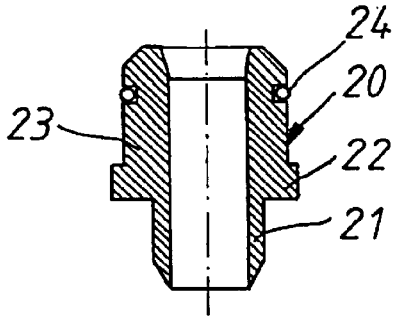
FIG. 5 is a longitudinal section through the regulating piece of the air-reducing of valve of FIG. 1.

With reference now to the drawing, FIG. 1 shows the compressed air nozzle of the invention, shown here as a blow-out gun, and includes a system carrier consisting of system carrier or sleeve 1 which accommodates or holds all the components. According to FIG. 2, the system sleeve consists of lower section 2 which is provided with inside thread 3, middle section 4 which has hexagon socket 5, and upper section 6 with outer gearing 7 and/or an outer ribbing. An outside thread is also conceivable. In upper section 6 is a passage constriction in the form of a borehole 8. A chamber into which tilt valve 50 is inserted (see FIG. 8) is formed beneath borehole 8. The valve shaft projects through borehole 8 downstream beyond upper section 6 of system sleeve 1. When the valve is closed, valve cover or disk 51 is supported on a ring flange, which forms the borehole, thus forming a seal.

Figure 8:
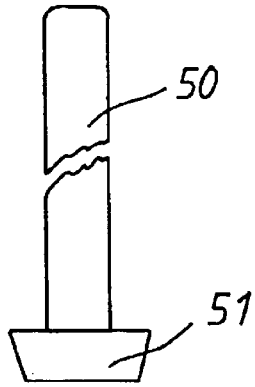
FIG. 8 is a side view of the valve pin of the tilt valve of FIG. 1.

As shown in FIGS. 3 and 4, insert 10 having sleeve 11, which is inserted into system sleeve 1 with an accurate fit, is provided upstream from the tilt valve 50 (see FIG. 8). Sealing element 12, which is connected to sleeve 11 by means of ribs which form passages, is located at the center of insert 10. The sealing element is slightly conical, the tip of the cone pointing upstream in the direction of the hose connection.

Upstream from sealing insert 10, regulating member 20 is provided and has connection 21 for connecting to a high-pressure hose 9. Regulating member 20 also has flange 22, which is in contact with the transition edge between lower section 2 and middle section 4 of system sleeve 1. Downstream from the flange is sealing section 23 with O-ring seal 24, in which case the outside diameter of the sealing section is selected so that it forms a seal against the inside diameter of middle section 4 of the system sleeve. Regulating member 20 is arranged in system sleeve 1 so that it is axially displaceable and it works together with sealing element 12 of sealing insert 10, with a larger or smaller passage cross section remaining for the pressurized medium, depending on the axial position of regulating member 20. This enables the air flow rate and pressure to be regulated.

Figure 7:
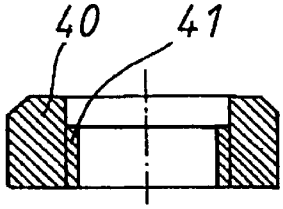
FIG. 7 is a longitudinal section through the lock nut of the air reducing valve of FIG. 1.

The position of regulating member 20 is adjusted by way of regulating sleeve 30 which is arranged upstream from the regulating member and has outside thread 31 which works together with inside thread 3 on system sleeve 1. In this way, regulating sleeve 30 can be screwed more or less into the system sleeve, which is connected to regulating member 20 so that the axial position of the regulating member can be adjusted by turning regulating sleeve 30. Lock nut 40, which is shown in FIG. 7, has inside thread 41, and is located between regulating sleeve 30 and system sleeve 1. The lock nut can be screwed onto outside thread 31 of regulating sleeve 30. Once the position of the regulating sleeve has been adjusted, it can be secured by the lock nut.

Figure 6:
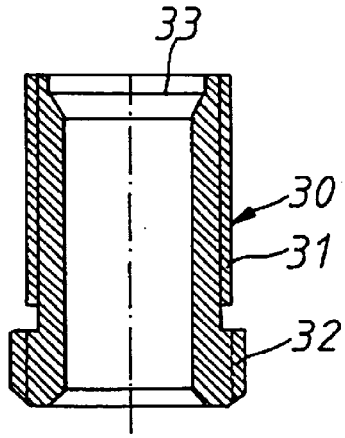
FIG. 6 is a longitudinal section through the regulating sleeve of the air-reducing valve of FIG. 1.

As previously indicated above, regulating member 20 has connection 21 over which high-pressure hose 9 can be forced. The regulating sleeve also has enlarged area 33 (see FIG. 6), which is used to accommodate the likely bulge in high-pressure hose 9, which is typically formed on insertion. After attaching the hose, regulating member 20 is pressed into regulating sleeve 30 by simply screwing it in, thus forming a tight connection between the regulating member, the regulating sleeve and the high-pressure hose. This integrated hose connection consisting of components 20 and 30 can be removed by simply unscrewing it from system sleeve 1 and then can be inserted into it again by screwing it in. At the same time, this hose connection serves as a counterpart to sealing element 12 of the air control valve. The fact that part 30 has been provided with an outside thread is a novel arrangement, enabling the insertion by screwing it in to be accomplished easily, quickly and can even be automated, both in the system block and in other selected compressed air tools having the same inside thread. This is thus a hose connection with an integrated air control valve, where the hose is held in the hose connection by simply inserting it there.

Figure 9:
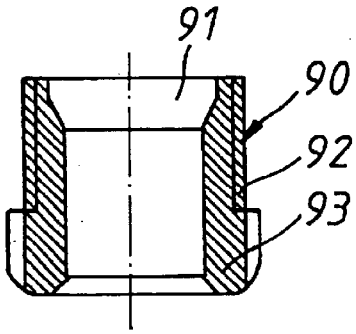
FIG. 9 is a longitudinal section through the connecting sleeve for the high pressure hose for use in a second embodiment of the invention, without an air reducing valve.
Figure 10:
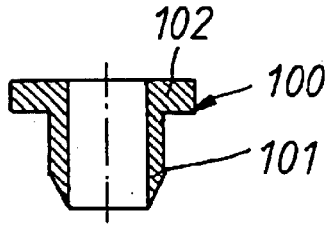
FIG. 10 is a longitudinal section through the clamping piece used with the connection sleeve for insertion of the high pressure hose of the FIG. 9 embodiment.

In another embodiment, the air-reducing valve, which is integrated into system sleeve 1 and at the same time forms the hose connection, may be omitted. A modified form of regulating sleeve 30, which is shown in FIG. 9, and is now referred to as connection sleeve 90, serves this purpose. This connection sleeve has essentially the same features as regulating sleeve 30, but it has a much shorter length. Outside thread 92 is also provided and is designed to fit with inside thread 3 of system sleeve 1. Flange 93 contacts the lower end of the system sleeve. Connection sleeve 90 works together with clamping member 100 (FIG. 10), which has connection 101 over which the hose 9 can be pushed. Then connection sleeve 90 is pushed over connection 101 and high pressure hose 9, with the hose being pressed between parts 90 and 100 so that flange 102 of clamping member 100 rests against the top edge of enlarged area 91 of connecting sleeve 90. The hose connection 90, 100 thus formed can then easily be inserted into system sleeve 1 or into some other compressed air tool accessory lines, while at the same time guaranteeing positive anchoring with the high pressure hose.

As illustrated in FIG. 1, an outer sleeve 60 having hexagon socket 61 is fu pushed onto hexagon insert bit 5 of system sleeve 1 (FIG. 2) and is arranged over the system sleeve as illustrated in FIG. 1, so that system sleeve 1 is protected by outer sleeve 60 and the hose socket is permanently connected to the system sleeve in such a way as to form a seal.

Figure 11A:
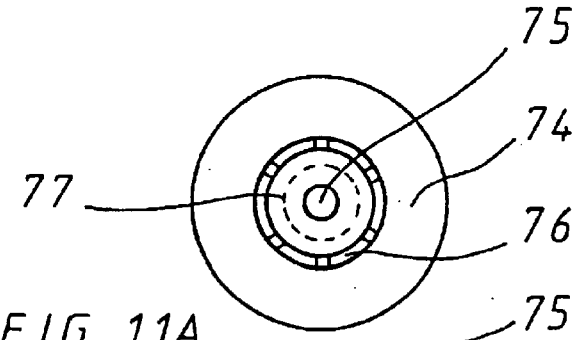
FIG. 11A is a top view of the tip of the hose socket of FIG. 11.
Figure 11:
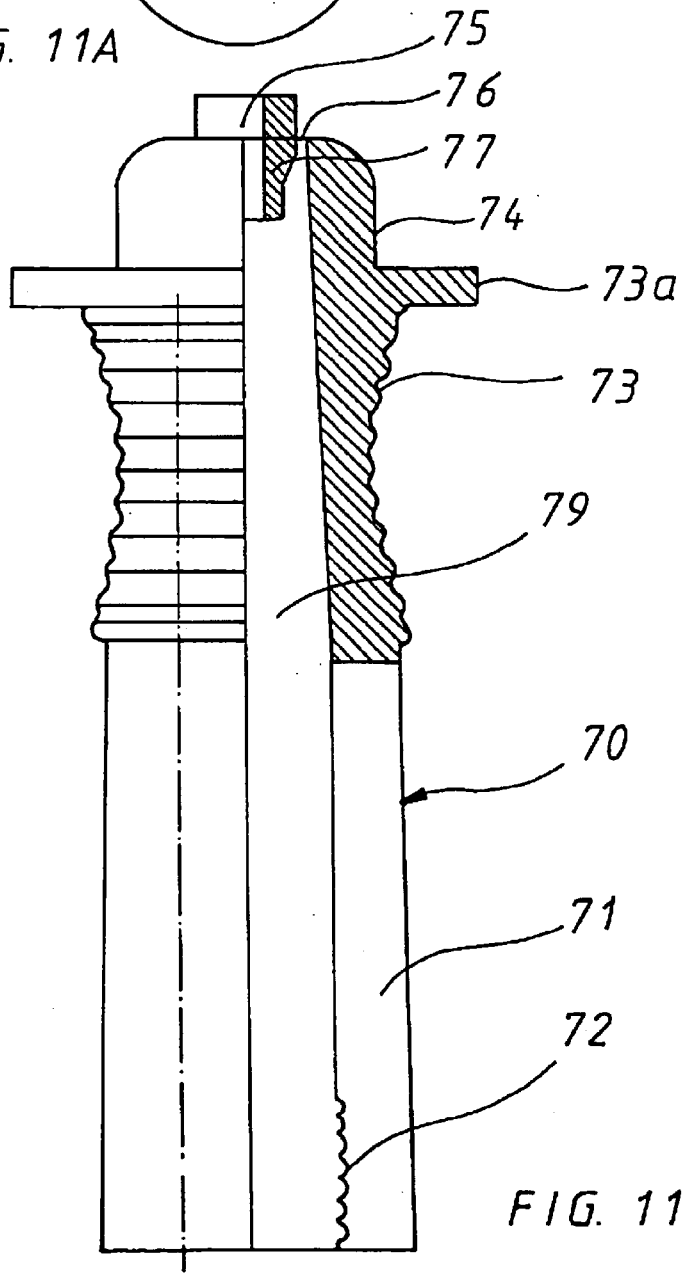
FIG. 11 is a partial sectional view through the hose socket of the invention.

Hose socket 70, which also overlaps with outer sleeve 60, is pushed onto outer gearing 7 of the upper section (see FIG. 2). The design of hose socket 70 is illustrated in detail in FIGS. 11 and 11A. The hose socket consists of a longwearing elastomer and is connected at its bottom section 71 to system sleeve 1 as described above. In a preferred embodiment, lower section 71 has internal gearing 72 for this purpose, ensuring a secure hold on outer gearing 7 of system sleeve 1 and itself being secured by outer sleeve 60.

Hose socket 70 has through-channel 79 into which valve shaft 50 of the tilt valve projects approximately into the upper region of the hose socket. The hose socket has an external finger rest 73. Through elastic deformation of the hose socket by means of pressure on finger rest 73, valve shaft 50 of the tilt valve is operated and flow of the pressurized medium is released, while finger guard 73*a* prevents the operators finger from slipping off or prevents injury due to movable parts of the work piece to be blasted out by the compressed air.

The pressurized medium flows in through-channel 79 to tip 74 of the hose socket and flows out through the central outlet nozzle 75. According to this invention, ring nozzle 76 is arranged around central outlet nozzle 75 so that a portion of the pressurized medium can also flow out through it. The pressurized medium flowing out of the outlet nozzle preferably yields a sharp stream running axially, whereas the pressurized medium flowing out of ring nozzle 76 comes out at an outlet angle 78 (FIG. 12) and forms a so-called compressed air shield which shields the operating person from chips and particles of dirt flying back away from the workpiece.

According to this invention, the area between central nozzle 75 and ring nozzle 76 is designed as a ring projection 77 which serves to provide protection against accidental contact, in which case when outlet nozzle 75 is pressed against a surface, the compressed air flows completely out of ring nozzle 76 and thus does not cause any damage on the surface. At the same time, this ring projection allows a pressure measurement to be performed on the compressed air coming out through the use of a conventional commercial automotive pneumatic pressure gauge, which is thus inexpensive.

Figure 12:
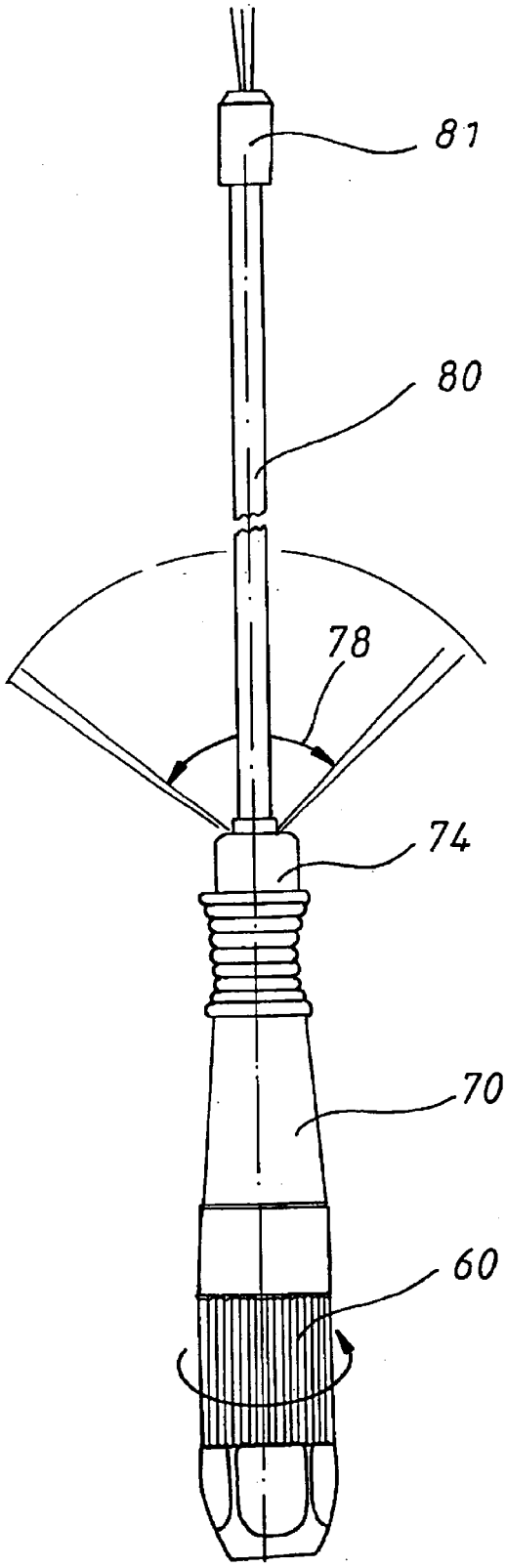
FIG. 12 is a side view of a preferred embodiment of the invention using a compressed air nozzle having an attached lengthening tube.

FIG. 12 shows a side view of a preferred embodiment of the compressed air nozzle of the invention. It can be seen that the outside of the blow-off gun is formed by outer sleeve 60 and hose socket 70 connected to it. This example also shows extension tube 80 which may be attached to outlet nozzle 75. The extension tube has front outlet nozzle 81, which may be designed according to central outlet nozzle 75. Ring nozzle 76 still functions as a compressed air shield, which is formed at an angle 78, as indicated schematically here. Extension tube 80 is optional and is not absolutely necessary for the functioning of the apparatus, unless desired because of the risk when working with rotating work pieces (with machines in operation).

The extension tube is preferably bendable in any desired shape and may be shortened to any desired length. Outlet nozzle 81 of tube 80 is rubberized on the outside in a preferred embodiment or it is provided with an elastic yoke so that this also guarantees protection from scratches, etc., on the workpieces to be machined.

Unless described otherwise, the parts of the nozzle of this invention are preferably made of a noncorroding lightweight metal, but insert 10 and tilt valve 50, as well as the outer sleeve and the hose socket with the exception of the tilt valve, are preferably made of plastic.

Figure 13:
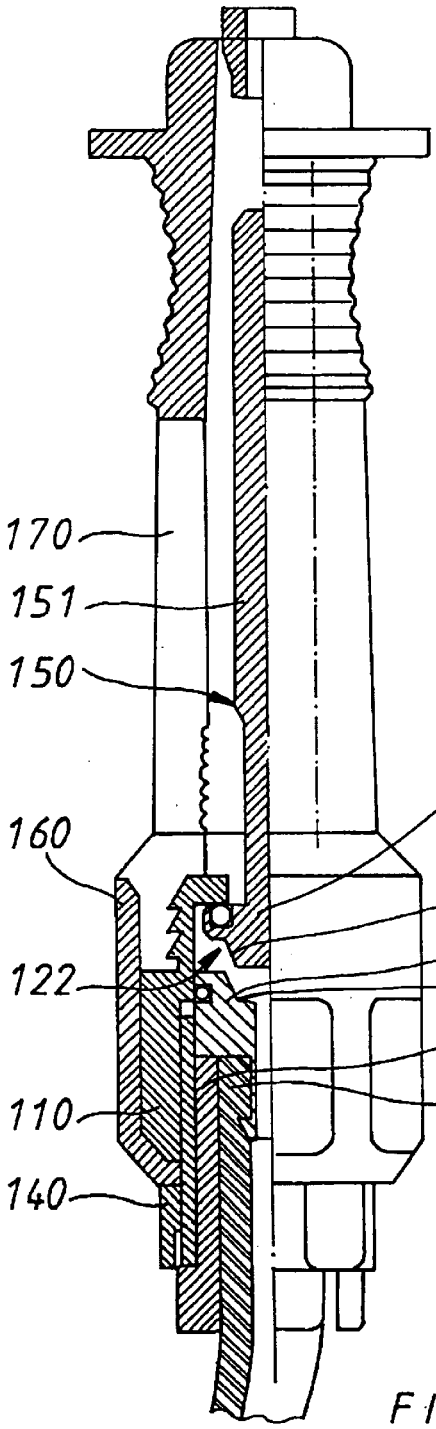
FIG. 13 is a longitudinal partial sectional view through another embodiment of the compressed air nozzle of the invention with the air-reducing valve opened.
Figure 14:
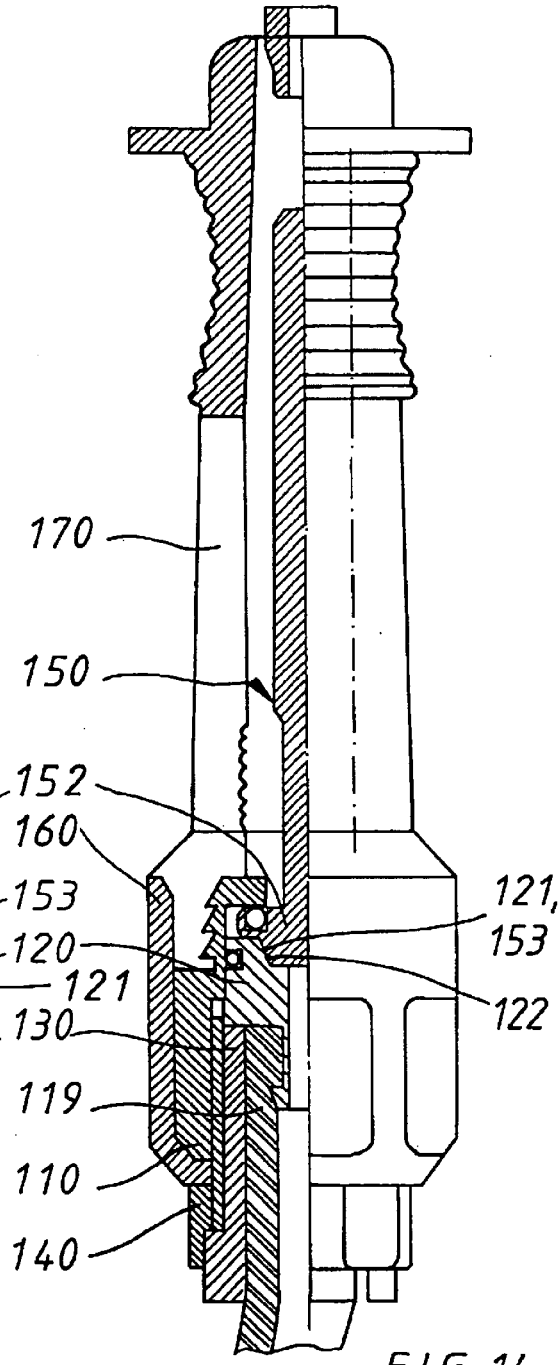
FIG. 14 is a longitudinal partial sectional view through the compressed air nozzle according to FIG. 13 with the air-reducing valve closed.

FIGS. 13 and 14 illustrate one variant of the compressed air nozzle with an air-reducing valve. As described above, the compressed air nozzle includes system sleeve 110, which is surrounded by outer sleeve 160, accommodating hose socket 170 between the system sleeve and the outer sleeve. The integrated hose connection is also formed by regulating member 120 and regulating sleeve 130 between which hose 119 is inserted. This new type of hose connection has already been described above.

In the same way as in the first embodiment, the hose connection, consisting of regulating member 120 and regulating sleeve 130, is at the same time designed as an air reducing valve which works directly together with tilt valve 150. The tilt valve 150 consists of valve shaft 151 and valve disk 152. Valve disk 152 is accommodated in system sleeve 110 and seals its outlet opening. Valve disk 152 and/or its pressure reducing area 153 are designed with gradations in cross section approximately in the shape of a truncated cone and they are opposite regulating member 120 whose contact area 121 is designed according to the shape of pressure reducing area 153 of valve disk 152.

FIG. 13 shows the air-reducing valve in an open state. Regulating member 120 can be moved toward and away from tilt valve 150 through regulating sleeve 130 accommodated in a thread of system sleeve 110 so that valve chamber 122 is formed with a movement against the direction of flow and the compressed air can flow into it. At the same time, valve disk 152 comes free of its seat in regulating member 120, so that through lateral pressure on valve shaft 151, valve disk 152 has moved away from its seat in chamber 122 on the inside of sleeve 110.

If regulating sleeve 130 is moved in the direction of flow together with regulating member 120, valve 122 is closed, as illustrated in FIG. 14, and regulating member 120 sits on valve disk 152. The valve is thus blocked. Tilt valve 150 can no longer be operated or opened. The set position of regulating sleeve 130 can be secured with lock nut 140.

Of course all intermediate control stages and positions of the regulating piece also conceivable, thus permitting precision control of the airflow.

In view of the above description it is likely that modifications and improvements will occur to those skilled in this technical field which are within the scope of this invention. The invention is limited and defined only by the appended claims and equivalents thereto.

What is claimed is:

1. A compressed air nozzle assembly comprising:

a system carrier, a connection for coupling said system carrier to a hose configured to be coupled to a source for pressurized fluid;

an adjustable fluid pressure reducing valve mounted in said system carrier, said pressure reducing valve comprising:

a tilt valve formed with a valve disk which is formed with a first pressure reducing area; and a regulating member having a second pressure reducing area, said first and second pressure reducing areas being combined to function as said fluid pressure reducing valve;

a tip;

a central outlet nozzle;

a ring nozzle around said central outlet nozzle, said ring nozzle projecting beyond the tip and being configured to produce an air shield;

a ring projection in the area between the central outlet nozzle and the ring nozzle, said ring projection providing contact protection; and a regulating sleeve being longitudinally adjustable and coupled to said adjustable pressure reducing valve for controlling fluid flow through said assembly.

2. A compressed air nozzle assembly comprising:

a system carrier;

a connection for coupling said system carrier to a hose configured to be coupled to a source for pressurized fluid;

an adjustable fluid pressure reducing valve mounted in said system carrier, said pressure reducing valve comprising:

a tilt valve formed with a valve disk which is formed with a first pressure reducing area; and a regulating member having a second pressure reducing area, said first and second pressure reducing areas being combined to function as said fluid pressure reducing valve;

a tip;

a central outlet nozzle;

a ring projection which projects beyond said tip and serves to provide contact protection, said ring projection being configured to accommodate the connection of a conventional automotive tire air pressure gauge; and a regulating sleeve being longitudinally adjustable and coupled to said adjustable pressure reducing valve for controlling fluid flow through said assembly.

3. A pressurized fluid nozzle assembly comprising:

a system carrier;

a connection for coupling said system carrier to a hose configured to be coupled to a source for pressurized fluid;

an adjustable fluid pressure reducing valve mounted in said system carrier, said pressure reducing valve comprising:

a tilt valve formed with a valve disk which is formed with a first pressure reducing area; and a regulating member having a second pressure reducing area, said first and second pressure reducing areas being combined to function as said fluid pressure reducing valve;

a tip;

a central outlet nozzle;

a ring nozzle around said central outlet nozzle, said ring nozzle projecting beyond the tip, and being configured to produce an air shield;

a ring projection in the area between the central outlet nozzle and the ring nozzle, said ring projection providing contact protection; and a regulating sleeve being longitudinally adjustable and coupled to said adjustable pressure reducing valve for controlling fluid flow through said assembly;

wherein said regulating member and said regulating sleeve are configured for connection and for support of said hose for the supply of pressurized fluid.

4. A pressurized fluid nozzle assembly comprising:

a system carrier;

a connection for coupling said system carrier to a hose configured to be coupled to a source for pressurized fluid;

an adjustable fluid pressure reducing valve mounted in said system carrier, said pressure reducing valve comprising:

a tilt valve formed with a valve disk which is formed with a first pressure reducing area; and a regulating member having a second pressure reducing area, said first and second pressure reducing areas being combined to function as said fluid pressure reducing valve;

a tip;

a central outlet nozzle;

a ring nozzle around said central outlet nozzle, said ring nozzle projecting beyond the tip and being configured to produce an air shield;

a ring projection in the area between the central outlet nozzle and the ring nozzle, said ring projection providing contact protection; and a regulating sleeve being longitudinally adjustable and coupled to said adjustable pressure reducing valve for controlling fluid flow through said assembly;

wherein said hose connection is configured to function as a pressure reducing valve.

5. A pressurized fluid nozzle assembly comprising:

a system carrier;

a connection for coupling said system carrier to a hose configured to be coupled to a source for pressurized fluid;

an adjustable fluid pressure reducing valve mounted in said system carrier, said pressure reducing valve comprising:

a tilt valve formed with a valve disk which is formed with a first pressure reducing area; and a regulating member having a second pressure reducing areas, said first and second pressure reducing areas combine to function as said fluid pressure reducing valve;

a tip;

a central outlet nozzle;

a ring nozzle around said central outlet nozzle, said ring nozzle projecting beyond the tip and being configured to produce an air shield;

a ring projection in the area between the central outlet nozzle and the ring nozzle, said ring projection providing contact protection; and a regulating sleeve being longitudinally adjustable and coupled to said adjustable pressure reducing valve for controlling fluid flow through said assembly;

wherein said regulating member and said regulating sleeve are configured for connection and for support of said hose for the supply of pressurized fluid, and wherein said hose connection is configured to function as a pressure reducing valve.

6. The nozzle assembly of claim 1, wherein the connection is a hose connection, and wherein said pressure reducing valve comprises:

an insert formed with a sealing element;

a regulating member; and a regulating sleeve.

7. The nozzle assembly of claim 1, wherein said regulating member and said regulating sleeve are configured so that they are displaceable with respect to said system carrier to thereby control said fluid pressure reducing valve.

8. The nozzle assembly of claim 1, wherein:

said compressed air hose is inserted between said regulating member and said regulating sleeve; and said regulating member is inserted with a seal into said system carrier where it is locked in position by a connecting sleeve which is screwed into said system carrier.

9. The nozzle assembly of claim 8, wherein said connecting sleeve is configured to be inserted into said system carrier and together with a clamping piece it is configured for connection and support of said hose for the supply of the pressurized fluid.

10. The nozzle assembly of claim 1, wherein said assembly has a permanently connected hose socket formed with a compressed air shield integrated into said hose socket.

11. The nozzle assembly of claim 10, and further comprising a connection for an automotive air pressure gauge integrated into said hose socket.

12. The nozzle assembly of claim 10, wherein said hose socket is formed with means to protect against accidental contact.

13. The nozzle assembly of claim 10, and further comprising an outer sleeve surrounding said system carrier, said system carrier and outer sleeve together accommodate the lower portion of said hose socket between them.

14. The nozzle assembly of claim 10, and further comprising:

an outlet valve;

said hose socket having a lower section configured to attach to said system carrier, a middle section with a finger rest and/or a finger guard for operation of said outlet valve, and an upper section with a tip which has a central outlet nozzle for the pressurized medium.

15. The nozzle assembly of claim 14, wherein said finger rest has an integrally molded ring flange.

16. The nozzle assembly of claim 1, and further comprising:

pneumatic safety shield means; and a removable extension tube integrated with said safety shield.

17. The nozzle assembly of claim 16, and further comprising:

a hose socket;

wherein said extension tube is provided with a collar on the pressurized fluid end which prevents unintentional loosening of said extension tube after being inserted into said hose socket and allows it to be loosened from said hose socket when a greater force is applied.

18. The nozzle assembly according to claim 5, wherein the regulating sleeve of the air reducing valve is inserted beneath the tilt valve.

19. The nozzle assembly according to claim 5, wherein the regulating member and the regulating sleeve are configured for connection and for supporting the hose for the supply of compressed air, and wherein the compressed air hose is inserted between the regulating piece and the regulating sleeve, and the resulting hose connection can be screwed into the system sleeve.

20. The nozzle assembly according to claim 5, and further comprising:

an insert having an insert sleeve, said insert being located in the system sleeve upstream from the tilt valve; and a sealing element connected to the insert sleeve by means of ribs, said sealing element being located at the center of the insert, and being slightly conical in shape so that the tip thereof is pointing upstream in the direction of the hose connection.

21. The nozzle assembly according to claim 5, and further comprising a regulating member with a connection means over which the high-pressure hose can be placed, said regulating member having an enlarged area to accommodate a bulge in the high-pressure hose.

* * * * *